US010890035B2

(12) United States Patent
Goff

(10) Patent No.: US 10,890,035 B2
(45) Date of Patent: Jan. 12, 2021

(54) SUCKER ROD ROLLING CENTRALIZER GUIDE

(71) Applicant: Malcolm Goff, Calgary (CA)

(72) Inventor: Malcolm Goff, Calgary (CA)

( * ) Notice: Subject to any disclaimer, the term of this patent is extended or adjusted under 35 U.S.C. 154(b) by 109 days.

(21) Appl. No.: 16/153,292

(22) Filed: Oct. 5, 2018

(65) Prior Publication Data

US 2019/0106947 A1 Apr. 11, 2019

Related U.S. Application Data

(60) Provisional application No. 62/569,360, filed on Oct. 6, 2017.

(51) Int. Cl.
*E21B 17/10* (2006.01)
*E21B 43/12* (2006.01)

(52) U.S. Cl.
CPC ..... *E21B 17/1057* (2013.01); *E21B 43/126* (2013.01)

(58) Field of Classification Search
CPC . E21B 17/1014; E21B 17/1057; E21B 43/126
See application file for complete search history.

(56) References Cited

U.S. PATENT DOCUMENTS

X712487 11/1902 Black
2,198,720 A 4/1940 Edgecomb et al.
2,466,239 A 4/1949 Holcombe
4,621,690 A 11/1986 Klyne
4,793,412 A * 12/1988 Rivas ..... E21B 17/1057 166/241.3
4,871,020 A * 10/1989 Rivas ..... E21B 17/1057 166/241.3
6,830,103 B2 12/2004 Bowles
7,395,881 B2 7/2008 McKay et al.
8,011,429 B2 9/2011 McNay
2015/0047829 A1* 2/2015 Millet ..... E21B 23/01 166/214

* cited by examiner

*Primary Examiner* — David J Bagnall
*Assistant Examiner* — Dany E Akakpo
(74) *Attorney, Agent, or Firm* — Parlee McClaws LLP; Chi Fai Andrew Lau

(57) ABSTRACT

A rod guide is provided for use on a rod string extending through a bore of a wellbore tubular. The rod guide has an elongate, generally cylindrical body configured to be connected in-line with a rod string, and a plurality of wheels rotatably fastened to the outside of the cylindrical body and configured to roll along the wellbore tubular. The plurality of wheels are angularly offset from each other to provide multiple rolling planes upon which the rod guide my roll, and can be arranged in series or in opposing pairs. The wheels also assist in centralizing the rod guide in the wellbore tubular. When arranged in a helical pattern, the wheels also facilitate rotation of the rod string.

19 Claims, 7 Drawing Sheets

SUCKER ROD ROLLING CENTRALIZER GUIDE

CROSS-REFERENCE TO RELATED APPLICATIONS

This application claims the benefit of US Provisional Patent application Ser. No. 62/569,360, filed Oct. 6, 2017, the entirety of which is incorporated herein by reference.

FIELD

Embodiments herein relate to sucker rods for use in oil and gas wells. In particular, embodiments herein relate to an improved sucker rod guide for reducing friction between a sucker rod string and tubing string in deviated wellbores and centralizing the sucker rod string within the tubing string.

BACKGROUND

Wellbores in oil and gas production operations extend from surface to one or more subterranean production zones for the production of hydrocarbons, such as oil and/or gas, therefrom. Wellbores are not necessarily straight throughout their length, but can deviate from the vertical axis at one or more locations along the wellbore, creating dogleg sections.

In typical production operations a tubing string, known as production tubing, extends from surface to the pump to provide a conduit for hydrocarbons to flow through to surface. A reciprocating pump can be positioned in the wellbore and actuated by a pump jack at surface, which is connected to the pump via a string of sucker rods extending through the production tubing, to produce hydrocarbons to surface. The sucker rod string is typically either a continuous member or a plurality of sucker rods connected end-to-end with a polished rod at the surface-end of the string. Rod strings transfer the reciprocating motion of the pump jack at surface to the pump downhole. Rod strings also support axial loads, such as the weight of the rod string and the force required to overcome friction between the rod string and the surrounding production tubing.

In scenarios involving off-vertical wellbores, such as horizontal wellbores or wellbores with dogleg sections, the rod string is biased to one side of the production tubing string. Reciprocation of the rod string, which is offset within the production tubing, can cause frictional wear to the rod string and to the tubing, which may necessitate premature stoppage of production to retrieve the rod string and/or production tubing for maintenance or replacement.

Additionally, when a rod string is passed through vertical sections of the wellbore, it is also desirable to centralize the rod string to prevent the rod string from unevenly contacting the production tubing and causing premature wear.

Sucker rod guides are known to address some of these issues. A device taught in U.S. Pat. No. 4,621,690 to Klyne, as depicted in FIG. 1A, addresses the issue of friction between the rod string and tubing. The device is mounted periodically along the rod string. The device comprises wheels mounted inside axially-extending, substantially diametric, axially and angularly spaced slots formed in a cylindrical body, such that the wheels protrude beyond the outer diameter of the body. The wheels act as axial anti-friction rollers when contacting the surrounding tubing during reciprocation of the rod string. However, the device of Klyne is problematic as the axially-extending, substantially diametric slots weaken the structure of the body, resulting in potential fracture points, especially adjacent the wheel axle pin bores formed in the body. As such, the device taught in Klyne is not suited for high load applications. Additionally, the use of a narrow, single wheel for rolling along surrounding tubing can result in the wheel bearing a substantial amount of load on a relatively small contact surface, which in turn causes the wheel to wear out quickly. Additionally, the narrow wheels are subject to greater fatigue in high deviation wells when the device navigates areas of high curvature, due to the cyclic, lateral stresses on the body at points of high curvature. Further, in situations where the rod string must be rotated, for example to shift the load bearing area of the rod guide, the transverse loads on the narrow wheels of the device of Klyne can hinder rod string rotation or the wheels are while being rotated.

Turning to FIG. 1B, U.S. Pat. No. 7,395,881 to McKay, a similar assembly utilizes hemispherical wheels straddling an outside of the guide body to provide a larger contact area and avoid having slots formed in the body. However, the assembly taught in McKay is only capable of rolling in one orientation, that is, when resting under its own weight in an off-vertical portion of the well. Therefore, the rod string is not readily rotatable to reduce wear on the rod string and pump.

There remains a need for a sucker rod guide that reduces friction and wear between the rod string and production tubing in both vertical and lateral wellbore orientations with improved wear characteristics and structural integrity, and the ability to both centralize and rotate the rod string within production tubing or other wellbore tubulars.

SUMMARY

Generally, a rod guide is provided for reducing friction between a rod string and a surrounding wellbore tubular, such as production tubing, and centralizing the rod string within a bore of the tubing. In an embodiment, the rod guide comprises an elongate, generally cylindrical body for coupling with a rod string and a plurality of wheels each rotatably fastened to the outside of the body. The wheels are axially spaced and angularly offset from one another to provide multiple rolling planes upon which the rod guide may roll. The wheels can be generally hemispherical or otherwise be configured to present an axial profile that substantially occupies a cross-sectional area, or interface along a circumferential extent, of the bore of the tubing to centralize the rod guide therein. In some embodiments, the wheels can be arranged in opposing pairs on either side of the body. The wheels can also be arranged in a helical pattern to facilitate rotation of the rod string.

In a broad aspect, a sucker rod guide for use on a rod string extending through a bore of a wellbore tubular can comprise an elongate, generally cylindrical body having first and second connection means located at respective first and second ends; and a plurality of wheels rotatably fastened to the outside of the cylindrical body and configured to roll along the wellbore tubular; wherein the plurality of wheels are angularly offset from each other.

In an embodiment, the plurality of wheels comprise pairs of opposing wheels each fastened to opposite sides of the body.

In an embodiment, the rod guide comprises four pairs of opposing wheels, wherein each of the pairs is axially spaced from adjacent pairs and is angularly offset from adjacent pairs by 45 degrees.

In an embodiment, the rod guide comprises eight wheels, wherein each of the eight wheels is axially spaced from adjacent wheels and is angularly offset from adjacent wheels by 45 degrees.

In an embodiment, the plurality of wheels are configured to present an axial profile that occupies a substantial portion of a cross-sectional area or interface along a circumferential extent of the bore of the wellbore tubular while allowing for a radial clearance between the axial profile and the wellbore tubular when the rod guide is centered therein.

In an embodiment, the radial clearance is about 0.100".

In an embodiment, the plurality of wheels is configured to permit at least one other wheel of the plurality of wheels to contact the wellbore tubular.

In an embodiment, each of the plurality of wheels comprises a first portion for contacting the wellbore tubular and a second portion and top portion both configured to permit the first portion of at least one other wheel of the plurality of wheels to contact the wellbore tubular.

In an embodiment, the first portion has a curvature and the second portion has a reduced curvature or a negative curvature relative to the curvature of the first portion.

In an embodiment, each of the plurality of wheels comprises a circumferential portion for contacting the wellbore tubular, wherein each of the plurality of wheels has a height sufficient to permit the circumferential portion of at least one other wheel of the plurality of wheels to contact the wellbore tubular.

In an embodiment, for any given 90 degree extent about the rod guide, there are at least four potential contact points between the plurality of wheels and the wellbore tubular.

In an embodiment, the rod guide further comprises friction-reducing elements located between each of the plurality of wheels and a respective fastener of the wheel.

In an embodiment, the plurality of wheels are made of an abrasion resistant, low-friction material.

In an embodiment, each of the plurality of wheels is generally hemispherical in shape.

In an embodiment, the plurality of wheels is arranged in a helical pattern around the body.

In another broad aspect, a sucker rod guide for use on a rod string in a wellbore tubular, comprises an elongate, generally cylindrical body having first and second connection means located at respective first and second ends; and a plurality of pairs of opposing, generally hemispherical wheels, each wheel rotatably fastened to the outside of the cylindrical body and configured to roll along the wellbore tubular; wherein each pair of wheels is axially spaced from adjacent pairs and is angularly offset from adjacent pairs, such that the plurality of pairs of wheels are arranged in a double helical pattern around the body and present an axial profile that occupies a substantial portion of a cross-sectional area or interface along a circumferential extent of the bore of the wellbore tubular while allowing for a radial clearance between the axial profile and the wellbore tubular when the rod guide is centered therein; and wherein each of the wheels is configured to permit at least one other wheel of the plurality of pairs of wheels to contact the wellbore tubular.

In an embodiment, each of the wheels comprises a first portion for contacting the wellbore tubular and a second portion and a top portion both configured to permit the first portion of at least one other wheel of the plurality of wheels to contact the wellbore tubular, and wherein the first portion has a curvature and the second portion has a reduced curvature or a negative curvature relative to the curvature of the first portion.

In an embodiment, each of the wheels comprises a circumferential portion for contacting the wellbore tubular, wherein each of the plurality of wheels has a height sufficient to permit the circumferential portion of at least one other wheel of the plurality of wheels to contact the wellbore tubular.

In an embodiment, the plurality of pairs of wheels comprises four pairs of wheels, and each of the pairs of wheels is angularly offset from adjacent pairs by 45 degrees.

In an embodiment, for any given 90 degree extent about the rod guide, there are at least four potential contact points between the plurality of wheels and the wellbore tubular.

DESCRIPTION

Figure 1A:
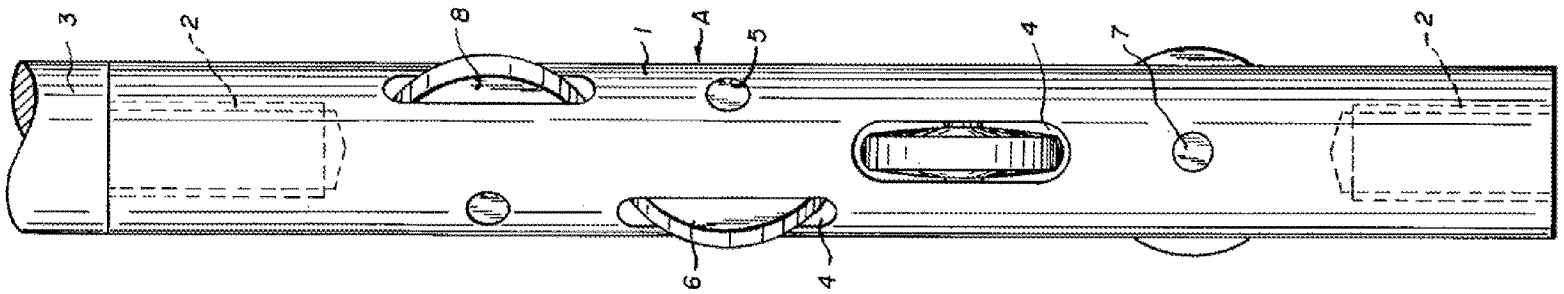
FIG. 1A (Prior Art)
FIG. 1A is a side elevation view of a prior art rod guide.
Figure 1B:
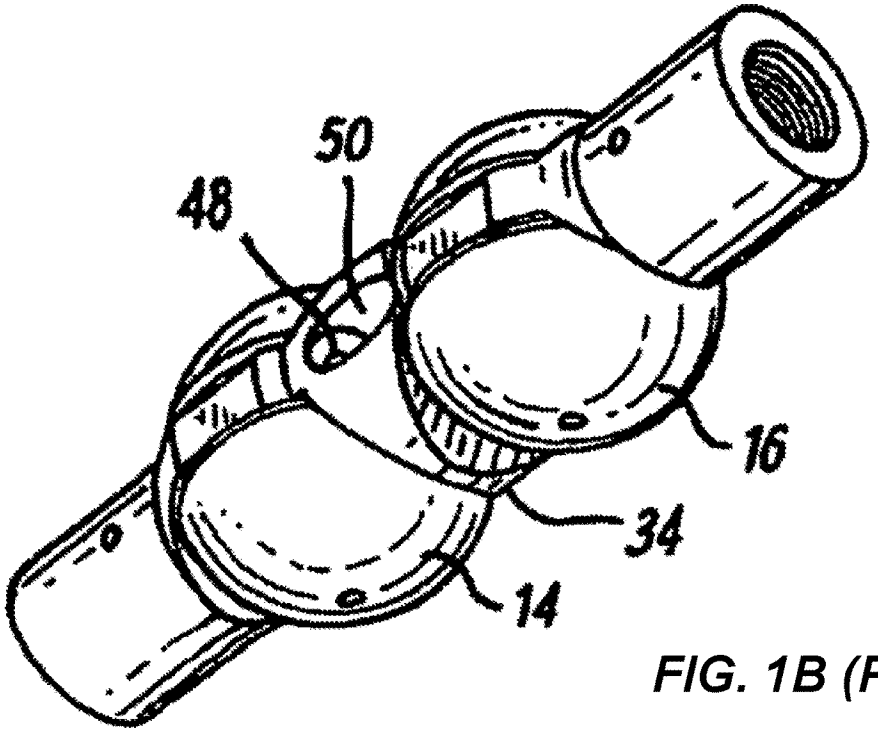
FIG. 1B (Prior Art)
FIG. 1B is an isometric view of a prior art rod guide.

With reference to FIGS. 2A-4D, an improved rod guide 10 is provided herein for reducing friction between a rod string and a surrounding wellbore tubular 8, such as a production tubing string, and for centralizing the rod string within the tubing 8.

The improved rod guide 10 comprises an elongate, generally cylindrical body 12 configured to be located along a rod string. A plurality of wheels 30 are mounted on the body 12 and configured to roll along tubing 8 when in contact therewith. Each wheel 30 can be generally hemispherical to provide a large contact surface with the surrounding tubing 8, thereby reducing wear to the wheels 30 and/or tubing string 8 and assisting in centralizing the rod string within the tubing 8. The wheels 30 are axially spaced and angularly offset from one another to provide an axial profile that occupies a substantial portion of the cross-sectional area, or interface along a circumferential extent, of the bore of the tubing string 8, which assists in centralizing the rod string within the tubing 8.

In embodiments, the wheels 30 can be provided in opposing pairs 30*p* mounted on the body 12 on a common axis, each wheel pair 30*p* axially spaced and angularly offset from adjacent pairs.

Applicant notes that terms such as "upper", "lower", "top", "bottom", and the like are used for convenience of describing relative locations, although the orientation of the rod guide 10 is not necessarily vertical, and the orientation of the rod guide 10 can be reversed without affecting its operation.

In detail, with reference to FIGS. 2A-2D, the cylindrical body 12 of the rod guide 10 has first and second connection means 16,20 located at first and second ends 14,18, respectively, for coupling with upper and lower sections of rod string (not shown). First and second connection means 16,20 are depicted in the figures as externally threaded pins, but one of skill in the art would understand that the first and second connection means 16,20 can be any suitable rod connection known in the art.

Figure 3A:
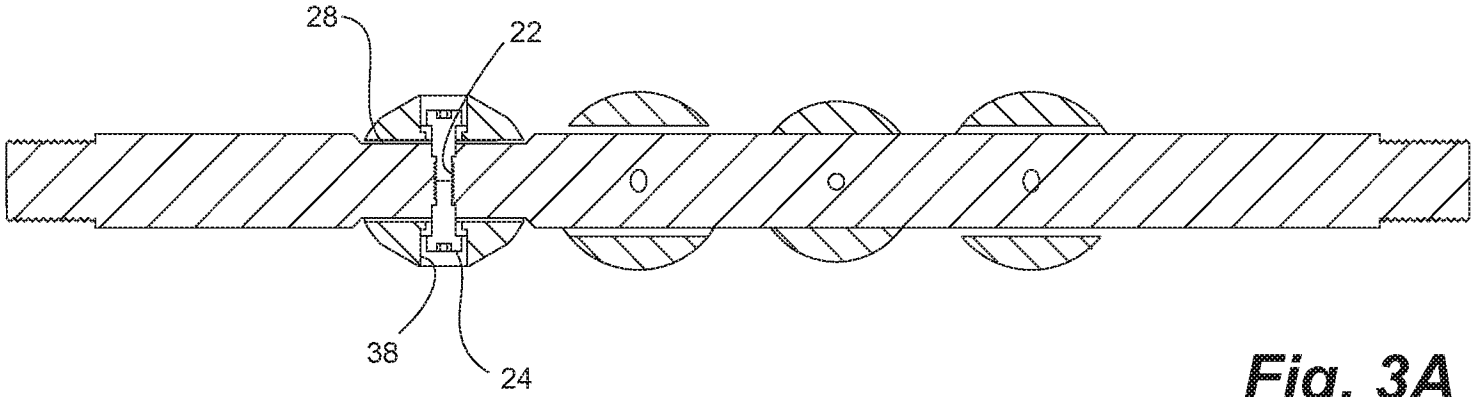
FIG. 3A is a side cross-sectional view of the rod guide of FIG. 2A.
Figure 3B:
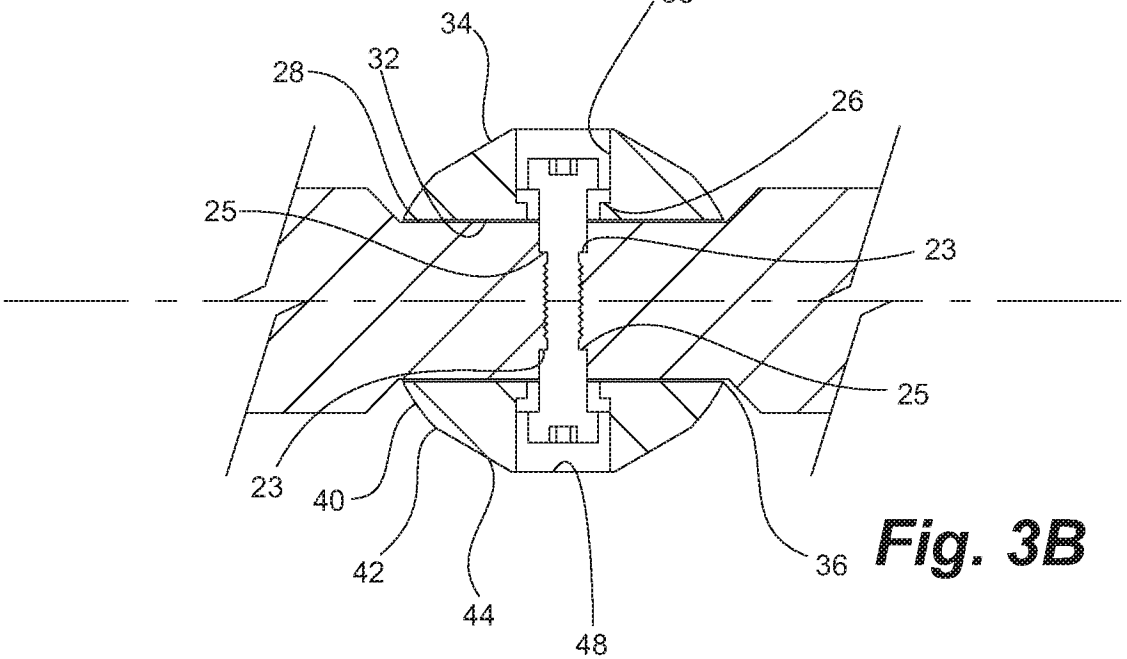
FIG. 3B is an enlarged view of a wheel pair of the rod guide of FIG. 3A.
Figure 3C:
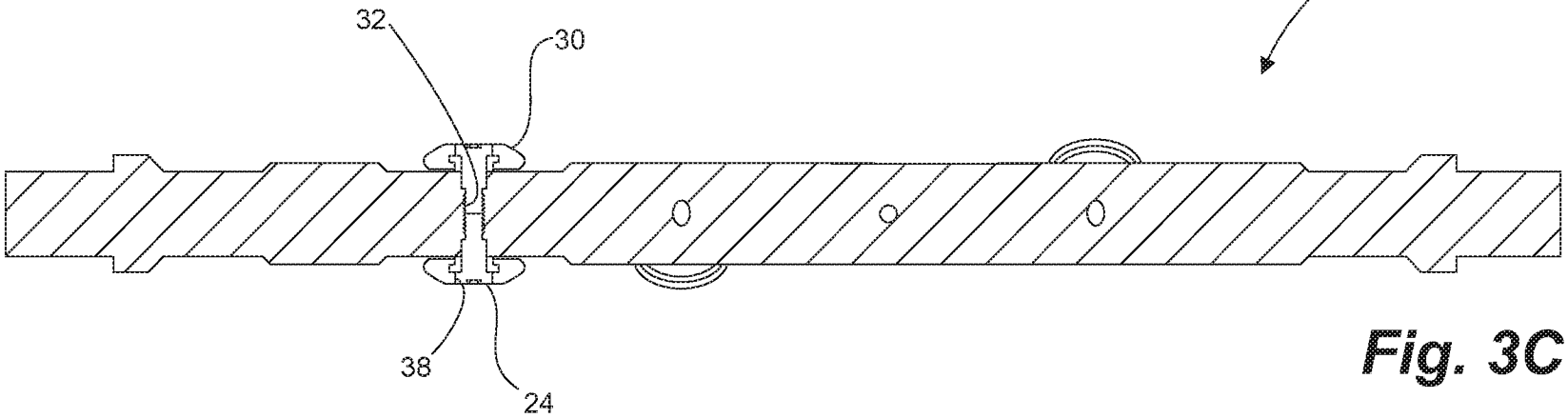
FIG. 3C is a side cross-sectional view of the rod guide of FIG. 2C.

As best shown in FIGS. 3A and 3C, a plurality of radial mounting bores 22 can be formed in the body 12 for receiving wheel mounting fasteners 24 such as shoulder bolts, screws, or other fasteners suitable for rotatably retaining the wheels 30 on the body 12. The fasteners 24 define an axis of rotation of their respective wheels 30. Optional friction-reducing elements 26, such as bushings, bearings, friction-reducing sleeves, and the like can be located between wheel fasteners 24 and wheels 30 to provide a lower friction interface upon which the wheels 30 may rotate. Each mounting bore 22 preferably has a bore shoulder 23 configured to abut a fastener shoulder 25 of a respective fastener 24 such that a gap is maintained between an inner face 32 of a respective wheel 30 and the body 12 when the fastener 24 is fastened into the mounting bore 22.

In embodiments, generally planar wheel mounting recesses 28, each configured to at least accommodate the diameter of a respective wheel 30, can be formed in the body 12 around the mounting bores 22 to provide a substantially flat interface surface between the body 12 and the wheels 30, thereby reducing spaces in the rod guide 10 in which wax, sand, and other undesirable material may accumulate, and improving wheel stability. The depth of the recesses 28 can be selected to accommodate various wheel sizes in a tubing 8 of a given diameter.

Figure 3D:
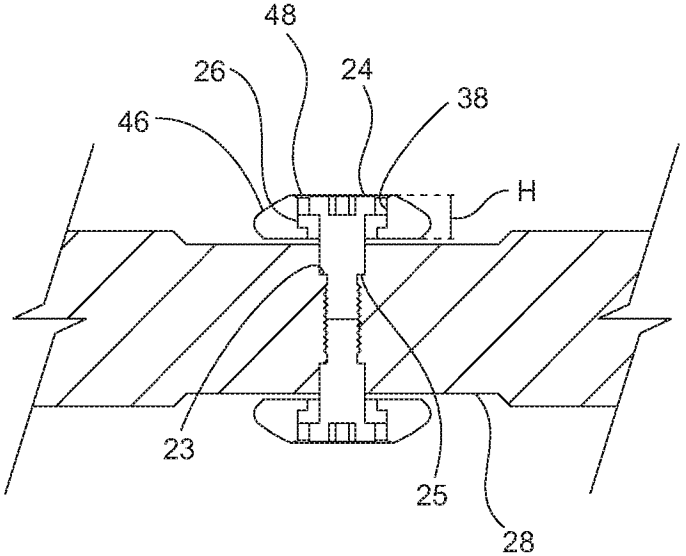
FIG. 3D is an enlarged view of a wheel pair of the rod guide of FIG. 3C

With reference to FIGS. 3B and 3D, each wheel 30 comprises an inner face 32, an outer face 34, and a central wheel bore 38 configured to receive a wheel fastener 24 for rotatably mounting the wheel to the body. Further, each wheel 30 is axially spaced apart and angularly offset from the other wheels 30 such that multiple rolling planes are provided upon which the rod guide 10 may roll. In preferred embodiments, at least a sufficient number of wheels 30 are provided at sufficient angular offsets such that the rod guide 10 can roll against the surrounding tubing 8 regardless of the rotational orientation of the rod guide 10 relative to the tubing 8. In other words, no matter how the rod string is rotated, at least one wheel 30 can roll against the tubing 8 if brought into contact therewith.

Preferably, to assist in centralizing the rod string in the tubing 8, the wheels 30 are also configured such that an axial profile of the rod guide 10, including wheels 30, occupies a substantial portion of the cross-sectional area, or interface along a circumferential extent, of the bore of the tubing string 8. The wheels 30 can also be generally hemispherical in shape to better approximate the curvature of the inner wall of the tubing string 8.

In a preferred embodiment, as best shown in FIG. 2A-2D, the wheels 30 are mounted in opposing pairs 30,30/30*p* on opposite sides of the body 12, each wheel pair 30*p* rotating on a common axis. Such embodiments permit a shorter length of body 12, as a shorter axial length is required in order for the wheel pairs 30*p* to form the desired axial profile than for single wheel embodiments. The wheel pairs 30*p* also more evenly distribute the forces experienced by the rod guide 10.

Figure 4C:
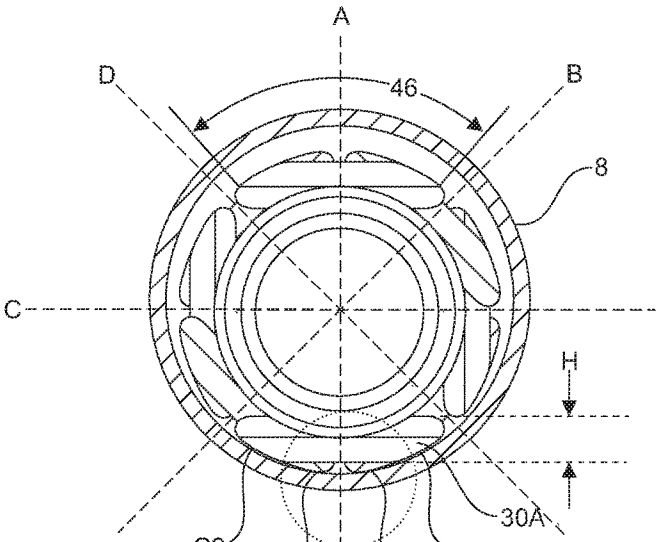
FIG. 4C is an axial view of the rod guide of FIG. 2C inside of a wellbore tubular.
Figure 4D:
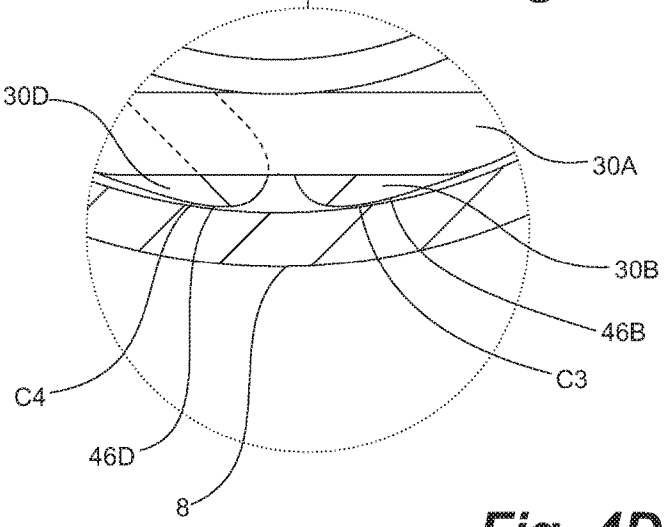
FIG. 4D is an enlarged view of the rod guide of FIG. 4C showing the contact point between the wheels of the rod guide and the wellbore tubular.
Figure 4A:
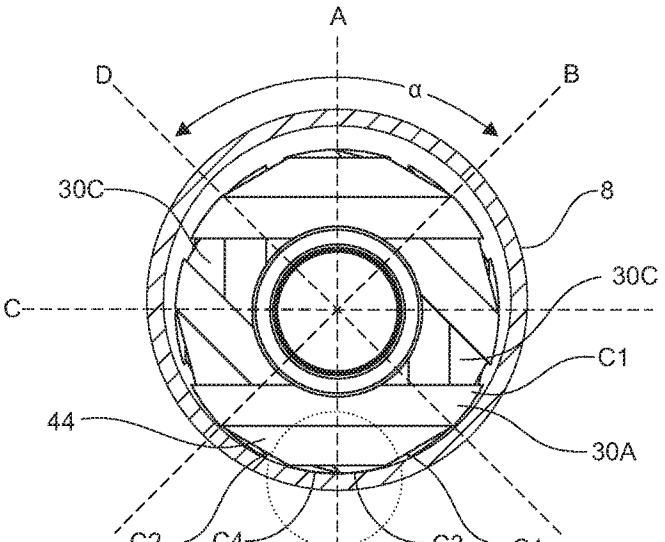
FIG. 4A is an axial view of the rod guide of FIG. 2A inside of a wellbore tubular.

In one exemplary embodiment, as shown in FIGS. 4A and 4C, four pairs 30*p* of generally hemispherical wheels 30 are rotatably fastened to the body 12 and each pair 30*p* is both axially spaced (into the page) and angularly offset from the adjacent pair by 45 degrees, forming a double helix pattern X. The wheel pairs 30*p* rotate on four axes A, B, C, D, each axis offset from adjacent axially spaced axes by 45 degrees. The wheels 30 are each similarly shaped to present a generally circular axial profile around the body 12 that substantially occupies the cross-sectional area of the bore of the surrounding tubing 8, while still being able to effectively contact and roll along the surrounding tubing 8.

In an alternative embodiment, the wheels are arranged sequentially rather than in opposing pairs, and each wheel 30 is angularly offset from the adjacent wheels by 45 degrees, forming a single helix pattern X of eight wheels 30.

The double or single helix arrangement X of the wheels 30 facilitates rotation of the rod string in the direction of the helix X. The wheels 30 can be configured such that the axial profile of the rod guide 10 is substantially at "drift" size, allowing some clearance between the axial profile and the inner diameter of the tubing 8, such that only one side of any given wheel 30 typically contacts the tubing 8 at any time to avoid binding of the wheels. For example, in an embodiment, the wheels 30 are sized to allow 0.100" of radial clearance when the rod guide 10 is centered in the bore of the tubing 8.

The wheels 30 can be formed of an abrasion resistant, low-friction material, such as bronze, brass, ultra-high molecular weight polyethylene, or another suitable material, to provide durability and friction-reduction properties.

As shown in FIGS. 3B and 4A, in an embodiment, to improve the rolling characteristics of the rod guide 10, the outer surface 34 of each wheel 30 can comprise a first portion 40 extending inward from a circumferential edge 36 of the wheel 30 to an interface 42, and a second portion 44 extending from the first interface to the wheel bore 38. The wheels 30 can further comprise a truncated or generally flat top 48 for material reduction and cost savings purposes. The first portion 40 can have a curvature similar to the curvature of the bore of the surrounding tubing 8, so as to provide a larger contact patch between the wheel 30 and tubing 8. As best shown in FIG. 3B, the second portion 44 and flat top 48 can be configured to permit better contact between the first portion 40 of the other wheels 30 of the rod guide 10 and the surrounding tubing 8. In some embodiments, it is not necessary for there to be a clear delineation between the first portion 40 and second portion 44 (i.e. there is no defined interface 42), so long as the second portion 44 is configured to permit contact between the first portion 40 of at least one of the other wheels 30 and the surrounding tubing 8. Further, in some embodiments, it is not necessary for the wheels 30 to have a truncated or flat top 48.

Figure 4B:
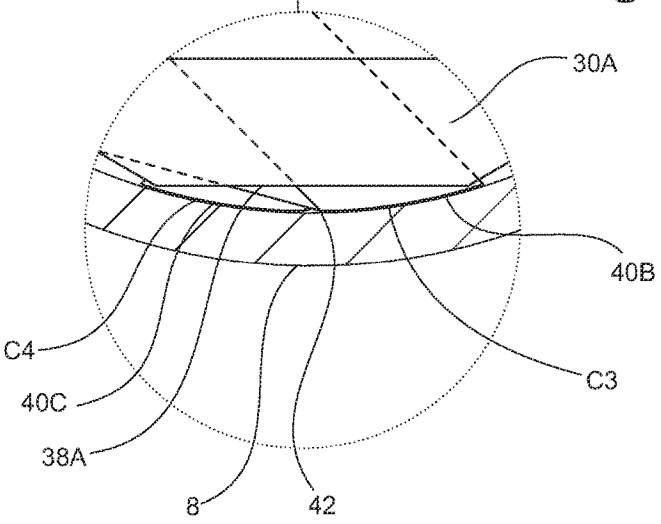
FIG. 4B is an enlarged view of the rod guide of FIG. 4A showing the contact point between the wheels of the rod guide and the wellbore tubular.

In one example embodiment, with reference to FIGS. 3B, 4A and 4B, and assuming the rod guide 10 is oriented in a horizontal position, the second portion 44 of the wheel 30A mounted on axis A need not have any curvature, and its slope is less than the slope of the first portion 40 immediately adjacent the first interface 42. Alternatively, the second portion 44 can have a reduced curvature or negative curvature relative to the curvature of the first portion 40. This permits the first portions 40 of the wheels 30C,30C mounted on axis C to extend slightly past the radial extent of the second portion 44 of wheel 30A and contact the production tubing 8 at contact points C1 and/or C2. Additionally, the flat top 38A of wheel 30A permits the respective first portions 40B,40D of the wheels 30B,30D respectively mounted on axes B and D to extend slightly past the radial extent of the top 38 of wheel 30A to contact the production tubing 8 at contact points C3 and/or C4, respectively. The rest of the wheels 30 are similarly shaped to permit the other wheels 30 of the rod guide 10 to better contact the tubing 8. Configured in this manner, for every 90 degree extent a about the rod guide 10, there are at least four potential contact points between the wheels 30 of the rod guide 10 and the tubing 8.

In an alternative embodiment, as shown in FIGS. 3D, 4C, and 4D, the outer face 34 of wheels 30 do not have defined first and second portions 40,44, but are continuous. The wheels 30 have a generally hemispherical shape, and circumferential portions 46 of the outer faces 34 of the wheels 30 are configured to contact the surrounding tubing 8. The circumferential portion 46 can have a curvature similar to the curvature of the bore of the surrounding tubing 8 so as to provide a larger contact patch between the wheel 30 and tubing 8. The radial height H of each wheel 30 is such that the circumferential portion 46 of at least one of the other wheels 30 of the rod guide 10 is able to at least partially extend radially beyond the maximum radial extent of the height H of a given wheel 30 to contact the surrounding tubing 8.

In one exemplary embodiment, as best shown in FIGS. 4C and 4D, and assuming the rod guide 10 is oriented in a horizontal position, the height H of wheel 30A permits the circumferential portions 46B,46D of respective wheels 30B, 30D to extend radially beyond the maximum radial extent of wheel 30A to contact the surrounding tubing 8 at contact points C3 and C4, respectively. Wheel 30A itself is able to contact the production tubing 8 at contact points C1 and/or C2. The rest of the wheels 30 are similarly shaped to permit the other wheels 30 of the rod guide 10 to contact the tubing 8. Such a wheel design and configuration permits the rod guide 10 to be used in smaller-diameter tubing 8 compared to the embodiment shown in FIGS. 2A,2B,3A,3B, and 4A. Configured in this manner, for every 90 degree extent a about the rod guide 10, there are at least four potential contact points between the wheels 30 of the rod guide 10 and the tubing 8. While it is undesirable for both contact points C1 and C2 to be in contact with the tubing 8 at the same time, as such contact would lead to binding of the wheel 30A, in practice such simultaneous contact of points C1 and C2 is uncommon, as the rod guide 10 would rock back and forth on the inner surface of the production tubing 8 such that, typically, only one of C1 or C2 would be engaged.

As one of skill in the art would understand, the wheels 30 can be of any configuration so long as at least one of the wheels 30 of the rod guide 10 is able to contact the surrounding tubing string 8 regardless of the rotational orientation of the guide 10 relative to the tubing 8. Preferably, the axial profile presented by the wheels 30 also assists in centralizing the rod guide 10. While embodiments having eight wheels 30 in four pairs 30*p* are described in the exemplary embodiments, rod guides 10 with more or fewer wheels 30 may be used with commensurate adjustment of angles and/or axes.

In use, rod guides 10 can be located along a rod string during production operations to reduce wear on the rod string and tubing 8, centralize the rod string, and assist the rod string in clearing deviations in the wellbore, such as dogleg sections. The rod guides 10 can be spaced along the rod string, be located at specific sections of rod string that pass through wellbore deviations, or located in any other manner suitable to facilitate production operations.

In a substantially vertical section of wellbore, the rod guide 10 functions to centralize the rod string due to the axial profile formed by the wheels 30. In deviated wellbore sections, the rod guide 10 enables the rod string to travel more efficiently therethrough by contacting and rolling axially along the surrounding tubing 8. If the rod string must also be rotated, the multiple rolling planes provided by the wheels 30 enable the rod guide 10 to continue rolling axially along the tubing 8. As the axial profile formed by the wheels 30 centralize the rod guide 10, the accumulation of wax, sand, and other debris in the working area through which the rod guide 10 is reciprocated is mitigated.

As the wheels 30 of the rod guide 10 are removably secured to the body 12 via fasteners 24, the wheels 30 can readily be replaced by retrieving the rod string, removing the fasteners 24, removing the wheels 30, and securing new wheels 30 to the body 12. The wheels 30 can also be exchanged for wheels 30 of different sizes, such that the rod guide 10 can be repurposed for other wellbores or adapted to changing wellbore conditions.

Figure 2A:
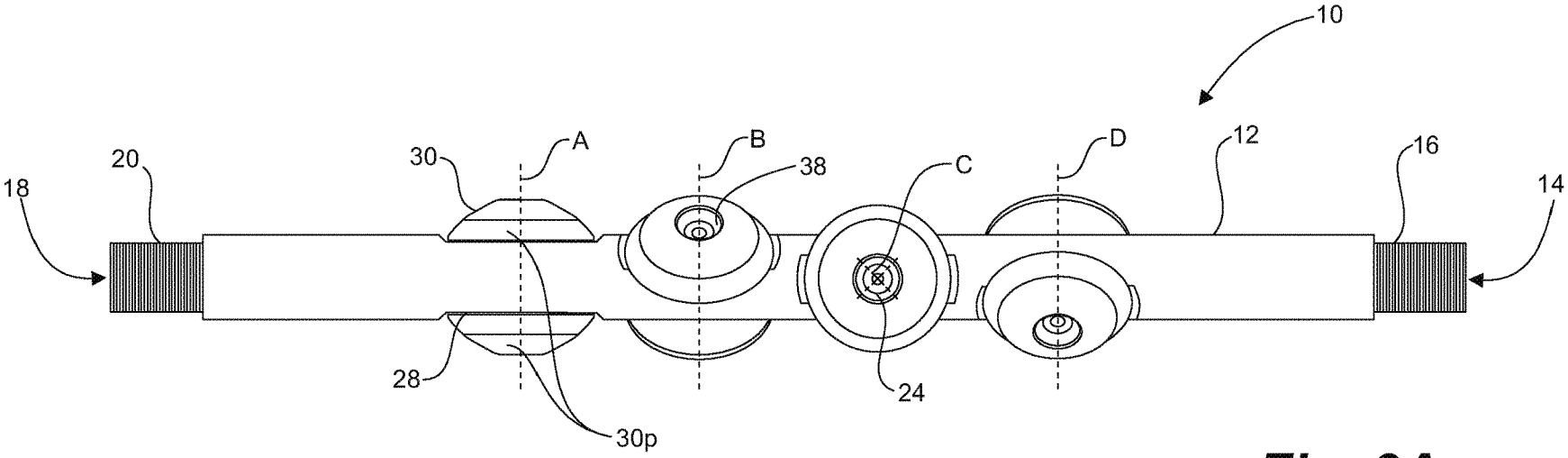
FIG. 2A is a side elevation view of a rod guide according to embodiments described herein having pairs of wheels arranged in a helix about the rod guide body.
Figure 2B:
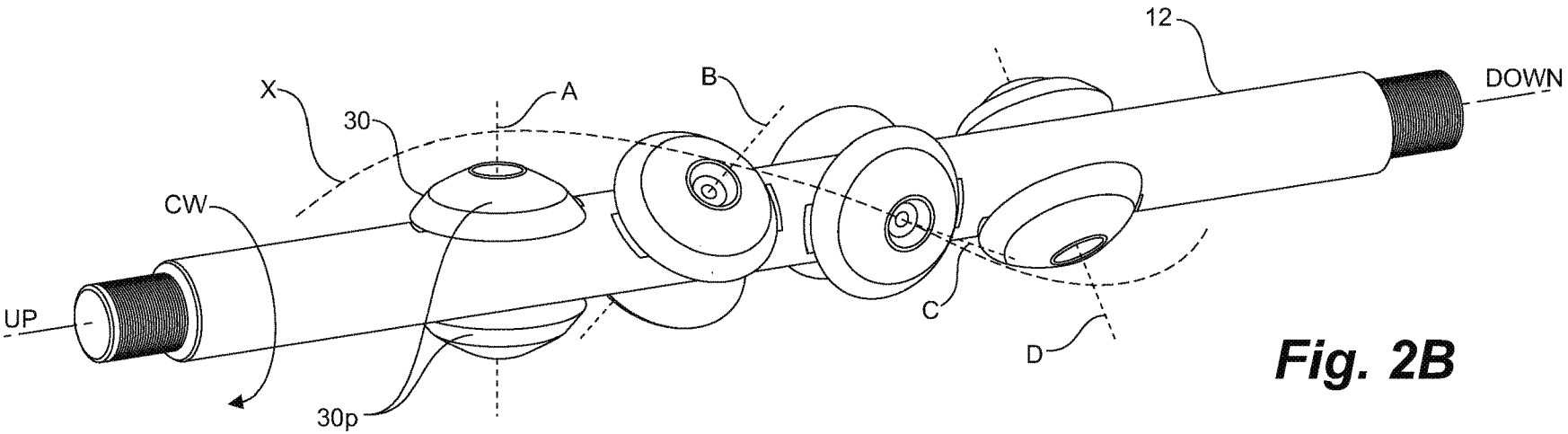
FIG. 2B is an isometric view of the rod guide of FIG. 2A.
Figure 2C:
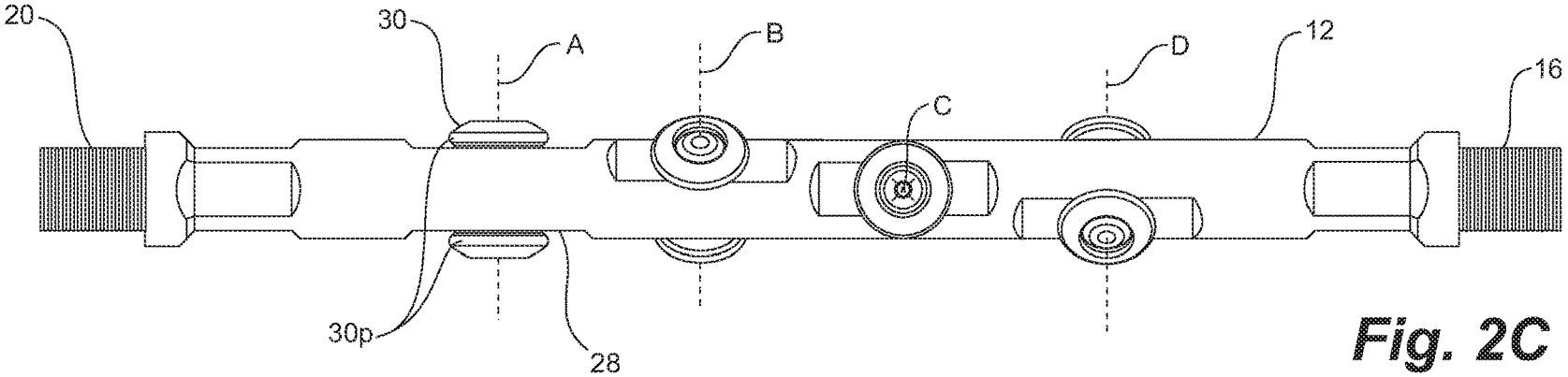
FIG. 2C is a side elevation view of another embodiment of a rod guide described herein.
Figure 2D:
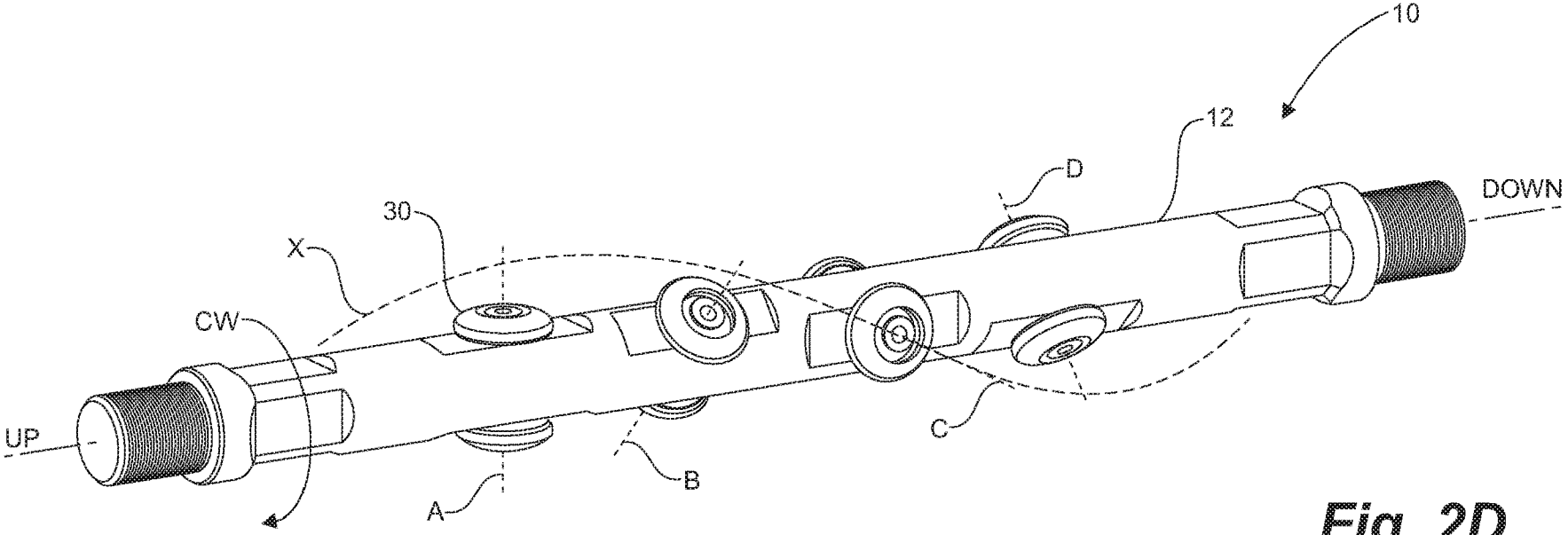
FIG. 2D is an isometric view of the rod guide of FIG. 2C.
Figure 2E:
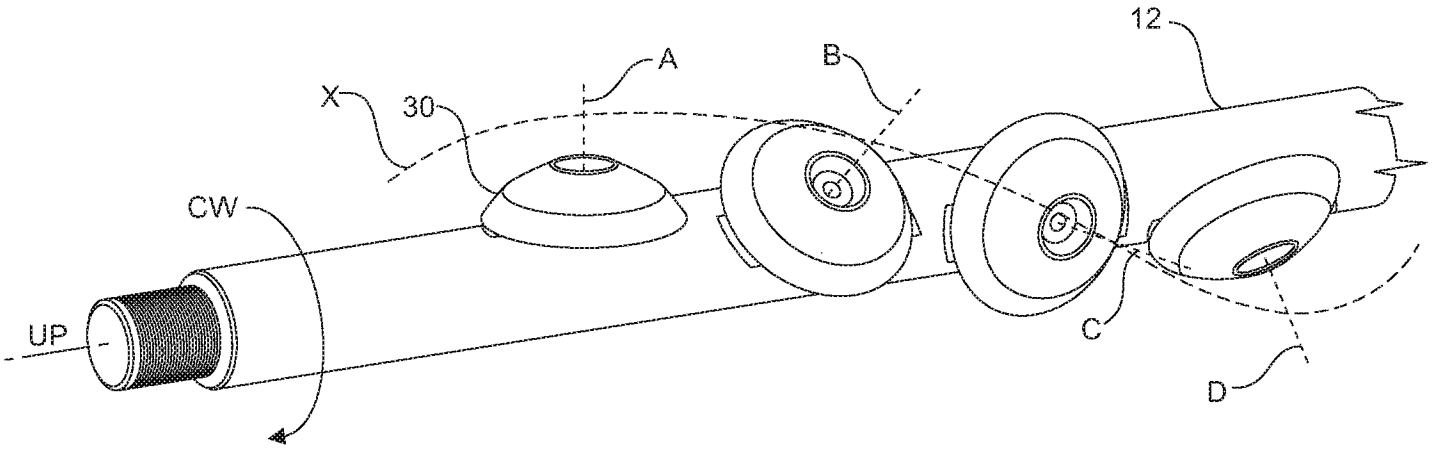
FIG. 2E is an isometric view of another embodiment of a rod guide described herein having single wheels arranged in a helix about the rod guide body.

In embodiments wherein the wheels 30 are arranged in a helical pattern X, as shown in FIG. 2B, the arrangement of the wheels 30 can assist in rotation of the rod string by stroking the rod string and rotating it in the direction of the helix X. For example, if the wheels 30 of the rod guide 10 are arranged in a clockwise helix X in the downhole direction, the rod string can be rotated in the clockwise direction CW by stroking the rod string downwards and rotating it in the clockwise direction. The helical arrangement of the wheels 30 provides an additional rotational force in the clockwise direction CW to assist in rotating the rod string. Of course, the rod string can be rotated in the opposite direction by stroking the rod string upwards and rotating it in the counter-clockwise direction.

The above described embodiments of a rod guide 10 are advantageous compared to existing rod guides, as the mounting of the wheels 30 on the outside of the body 12 increases the strength of the body 12, thereby allowing for greater load capacity and permitting use for deeper wellbores. The incorporation of a plurality of generally hemispherical, angularly offset wheels 30 provides much larger load bearing surfaces and load distribution compared to the narrow wheels of existing rod guides, resulting in reduced wear on the wheels and improved performance when navigating high curvature areas of the wellbore. Shaping of the wheels 30 to present a generally circular axial profile that substantially fills the bore of the tubing 8 assists in centralizing the rod string within the tubing 8.

I claim:

1. A sucker rod guide for use on a rod string extending through a bore of a wellbore tubular, comprising:

an elongate, generally cylindrical body having first and second connection means located at respective first and second ends; and a plurality of wheels rotatably fastened to the outside of the cylindrical body and configured to roll along the wellbore tubular;

wherein the plurality of wheels comprise pairs of radially opposing wheels each fastened to opposite sides of the body and are angularly offset from each other; and wherein the wheels of each pair have a common axis of rotation.

2. The sucker rod guide of claim 1, wherein the rod guide comprises at least two pairs of opposing wheels, wherein each of the pairs is axially spaced from adjacent pairs and is angularly offset from adjacent pairs.

3. The sucker rod guide of claim 1, wherein the plurality of wheels are configured to present an axial profile that occupies a substantial portion of a cross-sectional area or interface along a circumferential extent of the bore of the wellbore tubular while allowing for a radial clearance between the axial profile and the wellbore tubular when the rod guide is centered therein.

4. The sucker rod guide of claim 3, wherein the radial clearance is about 0.100 inch.

5. The sucker rod guide of claim 1, wherein each of the plurality of wheels is configured to permit at least one other wheel of the plurality of wheels to contact the wellbore tubular.

6. The sucker rod guide of claim 5, wherein each of the plurality of wheels comprises a first portion for contacting the wellbore tubular and a second portion and top portion both configured to permit the first portion of at least one other wheel of the plurality of wheels to contact the wellbore tubular.

7. The sucker rod guide of claim 6, wherein the first portion has a curvature and the second portion has a reduced curvature or a negative curvature relative to the curvature of the first portion.

8. The sucker rod guide of claim 5, wherein each of the plurality of wheels comprises a circumferential portion for contacting the wellbore tubular, wherein each of the plurality of wheels has a height sufficient to permit the circumferential portion of at least one other wheel of the plurality of wheels to contact the wellbore tubular.

9. The sucker rod guide of claim 5, wherein for any given 90 degree extent about the rod guide, there are at least four contact points between the plurality of wheels and the wellbore tubular.

10. The sucker rod guide of claim 1, further comprising friction-reducing elements located between each of the plurality of wheels and a respective fastener of the wheel.

11. The sucker rod guide of claim 1, wherein the plurality of wheels are made of an abrasion resistant, low-friction material.

12. The sucker rod guide of claim 1, wherein each of the plurality of wheels is generally hemispherical in shape.

13. The sucker rod guide of claim 1, wherein the plurality of wheels is arranged in a helical pattern around the body.

14. The sucker rod guide of claim 1, wherein the rod guide comprises four pairs of opposing wheels, wherein each of the pairs is axially spaced from adjacent pairs and is angularly offset from adjacent pairs by 45 degrees.

15. A sucker rod guide for use on a rod string in a wellbore tubular, comprising:

an elongate, generally cylindrical body having first and second connection means located at respective first and second ends; and a plurality of pairs of opposing, generally hemispherical wheels, each wheel rotatably fastened to the outside of the cylindrical body and configured to roll along the wellbore tubular;

wherein each pair of wheels is axially spaced from adjacent pairs and is angularly offset from adjacent pairs, such that the plurality of pairs of wheels are arranged in a double helical pattern around the body and present an axial profile that occupies a substantial portion of a cross-sectional area or interface along a circumferential extent of the bore of the wellbore tubular while allowing for a radial clearance between the axial profile and the wellbore tubular when the rod guide is centered therein; and wherein each of the wheels is configured to permit at least one other wheel of the plurality of pairs of wheels to contact the wellbore tubular.

16. The sucker rod guide of claim 15, wherein each of the wheels comprises a first portion for contacting the wellbore tubular and a second portion and top portion both configured to permit the first portion of at least one other wheel of the plurality of wheels to contact the wellbore tubular, and wherein the first portion has a curvature and the second portion has a reduced curvature or a negative curvature relative to the curvature of the first portion.

17. The sucker rod guide of claim 15, wherein each of the wheels comprises a circumferential portion for contacting the wellbore tubular, wherein each of the plurality of wheels has a height sufficient to permit the circumferential portion of at least one other wheel of the plurality of wheels to contact the wellbore tubular.

18. The sucker rod guide of claim 15, wherein the plurality of pairs of wheels comprises four pairs of wheels, and each of the pairs of wheels is angularly offset from adjacent pairs by 45 degrees.

19. The sucker rod guide of claim 15, wherein for any given 90 degree extent about the rod guide, there are at least four contact points between the plurality of wheels and the wellbore tubular.

* * * * *